US005652799A

United States Patent [19]

Ross et al.

[11] Patent Number: 5,652,799

[45] Date of Patent: Jul. 29, 1997

[54] NOISE REDUCING SYSTEM

[75] Inventors: Colin Fraser Ross, Stapleford; Andrew John Langley, Welwyn; Graham Paul Eatwell, Caldecote, all of England

[73] Assignee: Noise Cancellation Technologies, Inc., Linthicum, Md.

[21] Appl. No.: 635,855

[22] Filed: Apr. 22, 1996

Related U.S. Application Data

[63] Continuation of Ser. No. 254,829, Jun. 6, 1994, abandoned.

[51] Int. Cl.[6] ..... G10K 11/16

[52] U.S. Cl. ..... 381/71.11; 381/71.14

[58] Field of Search ..... 381/71, 94, 86

[56] References Cited

U.S. PATENT DOCUMENTS

| | | | |
|---|---|---|---|
| 4,473,906 | 9/1984 | Warnaka et al. | 381/73.1 |
| 4,654,871 | 3/1987 | Chaplin et al. | 381/72 |
| 5,046,103 | 9/1991 | Warnaka et al. | 381/71 |
| 5,105,377 | 4/1992 | Ziegler, Jr. | 381/71 |

FOREIGN PATENT DOCUMENTS 2 104 754 3/1983 United Kingdom .

OTHER PUBLICATIONS

Widrow and Stearns, Adaptive Signal Processing, 1985, pp. 128–131 and 350–353.

*Primary Examiner*—Forester W. Isen

[57] ABSTRACT

An active control system for attenuating tonal noise in a defined region is described. In its most basic form the system includes sensors for generating signals indicative of the residual noise in the region after attenuation and the uncontrolled sound affecting the region, signal processing circuit for processing the generated signals differently depending on the tonal content thereof, an adaptive filter supplied with at least one of the generated signals whose characteristic is controlled by the processing circuitry, a transducer for producing tonal-noise-attenuating disturbance in the region and delay means for delaying signals relating to the uncontrolled noise before or after or during the adaptive filtering. The system finds direct application in a personal headset or ear defender.

21 Claims, 8 Drawing Sheets

NOISE REDUCING SYSTEM

This application is a continuation of application Ser. No. 08/254,829, filed Jun. 6, 1994, now abandoned.

FIELD OF THE INVENTION

This invention relates generally to the selective attenuation of noise where tonal noises are attenuated more than broadband (random) noises. More specifically the tones may be produced by one or more sources of noise each of which generate noise at a fundamental frequency and possibly harmonic frequencies.

The tones reach a region where they provide a disturbance and reduce the ability of a person to hear other sounds which are generally of a more random nature (eg speech signals). The invention relates to an active noise control system which provides more attenuation of the tonal noises than of the random sounds in the region and does not require a signal link to the source or sources of tonal noise. In this context tonal noise includes narrow-band random noise, and noise includes vibration.

DISCUSSION OF SELECTED PRIOR ART

Headsets which selectively cancel the noise produced by a single rotating machine are known (Chaplin-GB2104754), but these require a link, by cable or ultrasonic/infrared transmission, to the source of repetitive noise in order to generate a trigger signal. For many machines the system requires one link per machine. This link or links can be inconvenient—if they are cable they restrict the movement of the wearer and if they are by transmission they may be unreliable as the wearer moves into regions where the transmission is obscured. GB2104754 describes the possibility of using a local microphone to obtain a signal to drive a phase-locked loop to generate a trigger signal but admits that this will only be effective when the repetitive noise is particularly regular. As described his method will not be able to deal with multiple sources of tonal noise.

At the present time, therefore, it appears that the selective attenuation of tonal noise in a region without the need for triggering signals derived from the source of tonal noise which can operate for multiple sources is unknown.

SUMMARY OF THE INVENTION

According to one aspect of the invention there is provided an active control system, for attenuating tonal noise more than random noise in a region, which does not require a signal link to the source or sources of the tonal noise, comprising transducer means to generate sounds in the region which interfere with the tonal noise to produce at least in part cancellation of the tonal noise and thereby attenuating the tonal noise more than random noise within that region.

a sensor or sensors in the region which provide a monitor signal related to the residual (quietened) noise in the region, first circuit means for effectively delaying a signal related at least in part to the uncontrolled sound in the region where selective attenuation is required, second circuit means for processing the effectively delayed signal (or signals derived therefrom, or from which the said signals are themselves derived and which may itself be modified by filtering) and the monitor signal (or signals derived therefrom, or from which the said signals are themselves derived and which may itself be modified by filtering), the result of which processing for tonal noises is generally different than that for random noise, an adaptive filter having the effectively delayed signal supplied thereto and adaptive attenuation characteristic is controlled by the second circuit means to produce signals for driving the transducer means, wherein the operation of the filter is adapted so as to selectively attenuate tonal sounds more than random sounds.

The processing in the second circuit means may include cross-correlating the effectively delayed signal (or signals derived therefore, or from which the said signals are themselves derived and which may itself be modified by filtering) and the monitor signal (or signals derived therefrom, or from which the said signals are themselves derived and which may itself be modified by filtering).

The processing in the second circuit means may include calculating the cross spectrum between the effectively delayed signal (or signals derived therefrom, or from which the said signals are themselves derived and which may itself be modified by filtering) and the monitor signal (or signals derived therefrom, or from which the said signals are themselves derived and which may itself be modified by filtering).

The said signal related at least in part to the uncontrolled sound in the region where selective attenuation is required may be obtained from a sensor located close to the region where selective attenuation is required.

Alternatively the said signal related at least in part to the uncontrolled sound in the region where selective attenuation is required may be obtained by subtracting the signals which drive the transducer means (or signals derived therefrom, or from which the said signals are themselves derived and which may itself be modified by filtering) from the monitor signal.

The first circuit means may effectively delay the signal it receives by actually delaying the signal it receives. Advantageously this delay is adjusted, by the first adaption unit means which is itself responsive the the spectrum or auto-correlation of the input to the first circuit means, so that the sum of this delay plus any delay in the transmission process from the transducer to the sensor providing the monitor signal is greater than the correlation time of the noises to be unattenuated and shorter than the correlation time of the noises to be attenuated. This means that the system is unable to attenuate noises with short duration cross-correlations (ie broadband random signals) and yet is able to attenuate noises with long duration cross-correlations.

In an alternative method of providing the effective delay in the first circuit means the first circuit means may include one or more narrow-band filters whose outputs are fed to the adaptive filter. These narrow-band filters can be fixed or tunable so that the centre frequencies can be adjusted to correspond to the frequencies of the tones to be cancelled and their bandwidth adjusted to include these tonal noises. The narrow-band filters being adjusted by the first adaption unit means which is itself responsive to the spectrum or auto-correlation of the input to the first circuit means.

The adaptive filter can include one or more parallel adaptive filter sections each of which has a characteristic at least partly determined by minimising the cross-correlation between its input and the monitor signals. Where the first circuit means includes narrow-band filters the individual filter outputs are fed one to each of the parallel adaptive filter sections of the adaptive filter. Each adaptive filter section may be a jth order finite impulse response filter where the coefficients are adjusted with a gradient descent algorithm.

When a separate sensor is used to produce the signal for input to the first circuit means, advantageously that sensor is positioned so that it is insensitive to the noise produced by the transducers or the effect of the transducers on the signal it produces is reduced by electronic subtraction.

The system may be incorporated in a headset or ear defender. Either one system would be used or alternatively two systems would be used so that the quietened region generally includes one or both ears.

When the system is incorporated in a headset or ear defender the sensors providing the monitor signal could be any transducer that can be used to infer the unsteady pressure at a point located close to each ear, for example, a microphone located close to each ear. The sensors providing the signal as input to the first circuit means could be one microphone located on or near the top of the headset or alternatively one close to the back of the shell of one or both earpieces, and in the further alternative no sensor is required specifically to generate this signal, the signal being derived from the monitor signal as described herein. The transducer may be any device capable of generating unsteady pressure fluctuations, for example a loudspeaker. The transducers may be mounted close to the ear so as to influence the unsteady pressure in the region around one or both ears, for example, the transducers may be mounted in the shell of one or both earpieces.

The headset can be of an open-backed type to allow the easy entry of desirable speech signals. The headset may be part of a communications headset where desirable sounds are reproduced through the loudspeakers. Additionally an effectively delayed and adaptive filter generally of the form described herein may be incorporated in the speech receiving microphone channel in order to attenuate the background tonal noises picked up by the microphone.

The Invention will now be described by way of example with reference to the accompanying drawings

IN THE DRAWINGS

DETAILED DESCRIPTION OF THE PREFERRED EMBODIMENTS

Figure 1:
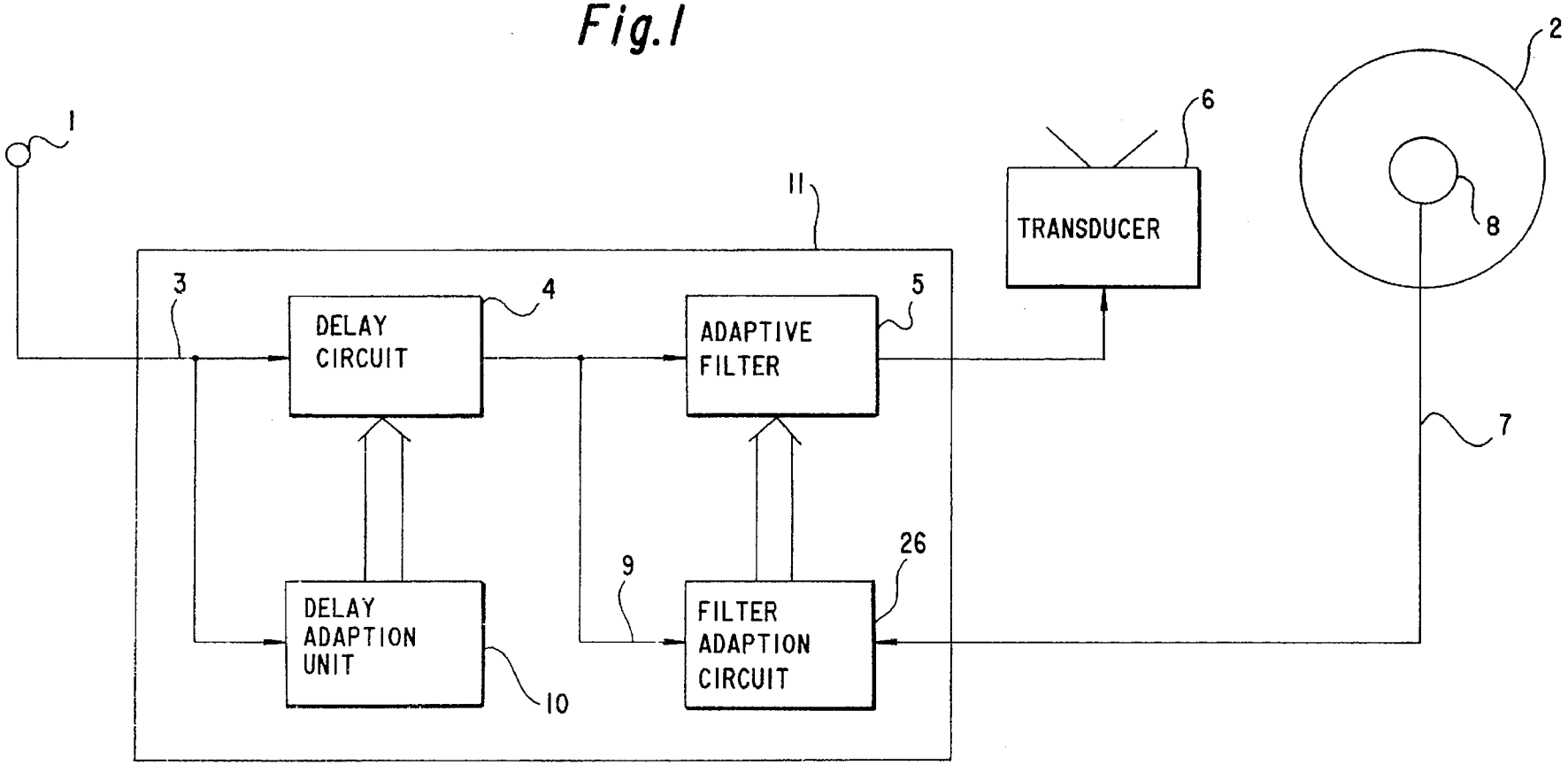
FIG. 1 is a block schematic diagram of one embodiment of the invention

FIG. 1 one shows a sensor, 1, which produces a signal representative of the sound in region 2. This signal, 3, is delayed in a first circuit means, 4, and the resultant signal fed via an adaptive filter, 5, to a transducer, 6, which generates sound to interfere with the sound in the region 2. The coefficients of the adaptive filter, 5, are adjusted by a second circuit means, 26, in accordance with an adaptive algorithm, described below, which uses monitor signal, 7, from a sensor, 8, in the region to be controlled, 2, and the input, 9, to the adaptive filter, 5. The first circuit means, 4, is adapted by the first adaption unit means, 10, in accordance with the spectrum or auto-correlation of the signal, 3. The delay is adjusted so that it is greater than the correlation time of the sound that is to be left unattenuated and yet less than the correlation time of the sound to be attenuated. This delay may be made to depend upon frequency where some frequency selectivity is required.

The adaptive algorithm of the second circuit means 26 is any adaptive algorithm which adjusts the adaptive filter in order to minimise the correlation between the filter's input and the monitor signal. These may be of the frequency domain type which involve calculating cross-spectra or the time domain type which involve cross-correlating. Many algorithms of this type are described in WIDROW & STEARNS 'adaptive signal processing'. One such time domain algorithm is described below:

The input signal, 9, is denoted by u(t) and the output of the adaptive filter section, 5, is denoted by y(t). Normally the signals are in sampled digital form having been converted by an analogue to digital converter either before or after the delay unit. The sampled version of the input and output are represented as u(k) and y(k) where k represents the time instant. The signals will be converted back to analogue form after the adaptive filter, 5. The output y(k) is related to the input by $$y(k) = \sum_{i=1}^{N} b(i)u(k-i)$$

where b(i) represents the ith coefficient of the filter.

The output of sensor, 8, the monitor signal, is w(k) and this comprises two components v(k), the uncontrolled noise, and the component due to the transducer, 6.

$$w(k) = v(k) + \sum_{i=1}^{M} c(i)y(k-i)$$

where c represents the effect of the transducer characteristic. The noise in the region to be controlled is minimised by adapting the coefficients b(i) using a gradient descent algorithm (for its derivation see WIDROW & STEARNS 'adaptive signal processing' published 1985 by prentice hall).

$$b_{j+1}(i) = b_j(i) - \mu r(k-i)w(k)$$

where $$r(k) = \sum_{j=1}^{M} c(j)u(k-j)$$

and $b_{j+1}(i)$ is the next update of the filter coefficient $b_j(i)$.

The expression r(k–i) w(k) can be interpretted as a single sample estimate of the cross-correlation between the two sugnals r and w. Other approximations are possible such as $$C(i) = 1/N \sum_{k=1}^{N} r(k-i) \cdot w(k),$$

where N can be any number.

k=1

Figure 5A:
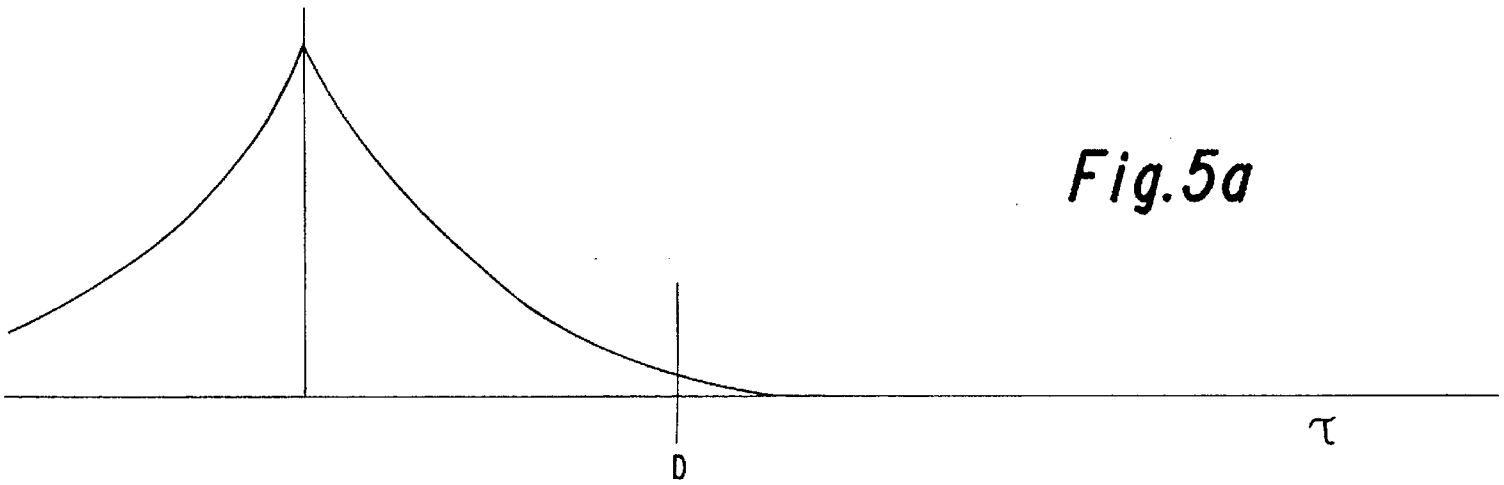
FIG. 5 shows example autocorrelations for random noise and for tonal noise.
Figure 5B:
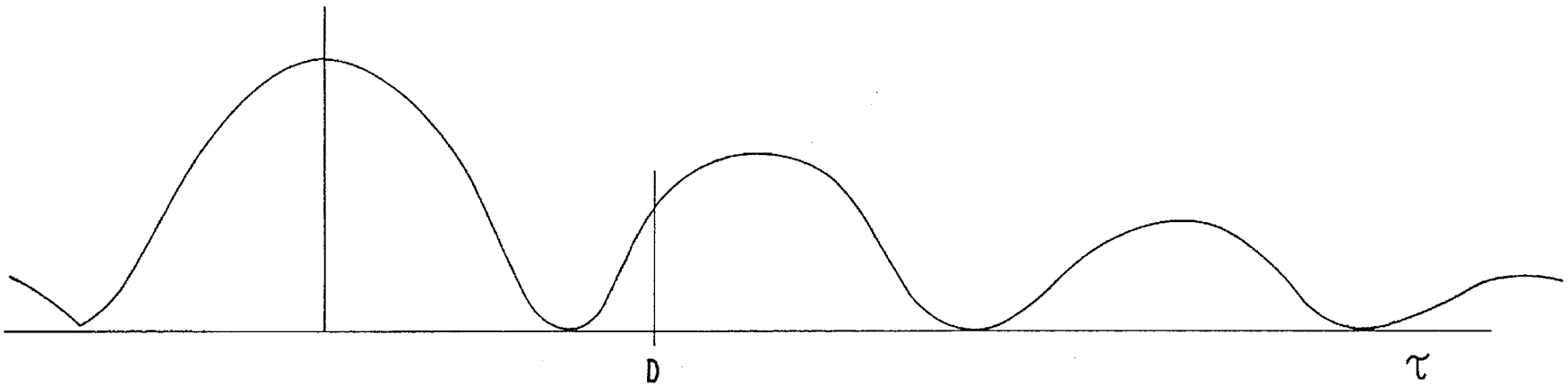

One particular novel feature of this invention is the ability of the circuit means, 11, to reduce the tonal noise more than the broadband random noise. This feature is now explained. The adaptive filter section described above will drive the correlation (for positive time lags) between its input and the monitor signal to zero by adjusting the coefficients of the filter so that a cancelling noise is produced to eliminate any noise which contributes to the correlation between the two. By introducing a delay into the input signal there will no longer be any correlation between the two (for positive time lags) for broadband noises with shorter correlation times. than the delay and thus the adaptive filter section will do nothing. On the other hand, sounds with a long correlation time, significantly longer than the delay, will still have a cross-correlation between the delayed input and the monitor signal and thus the adaptive filter will tend to cancel these to eliminate the correlation. FIG. 5*a* shows a typical cross-correlation of the input to the first circuit means and monitor signal when their sensors are close together and receiving broadband noise. FIG. 5*b* shows the typical cross-correlation when their sensors are receiving a narrow-band (tonal) sound. The introduction of a delay, D, shifts the cross-correlation so that the origin is at the point marked D. Since the adaptive filter is only able to control the sounds with a significant level of cross-correlation to the right of the origin only the narrow-band signal will be controlled. If the system receives a combination of many noises it will eliminate all those with a cross-correlation beyond the point D and so it will eliminate all tones.

It is desirable that the signal, 3, is not contaminated with noises received by its sensor, 1, from the transducer, 6. This may be achieved by making the sensor, 1, directional so that it is insensitive to sounds from the transducer, or by positioning it so that it is insensitive, or by providing an additional filter which takes the transducer signal as an input and whose output is used to subtract the effect of the transducer from the sensor signal in a manner similar to that described for eliminating the effect of the transducer produced noise on the monitor signal.

Alternative Embodiments

Figure 2:
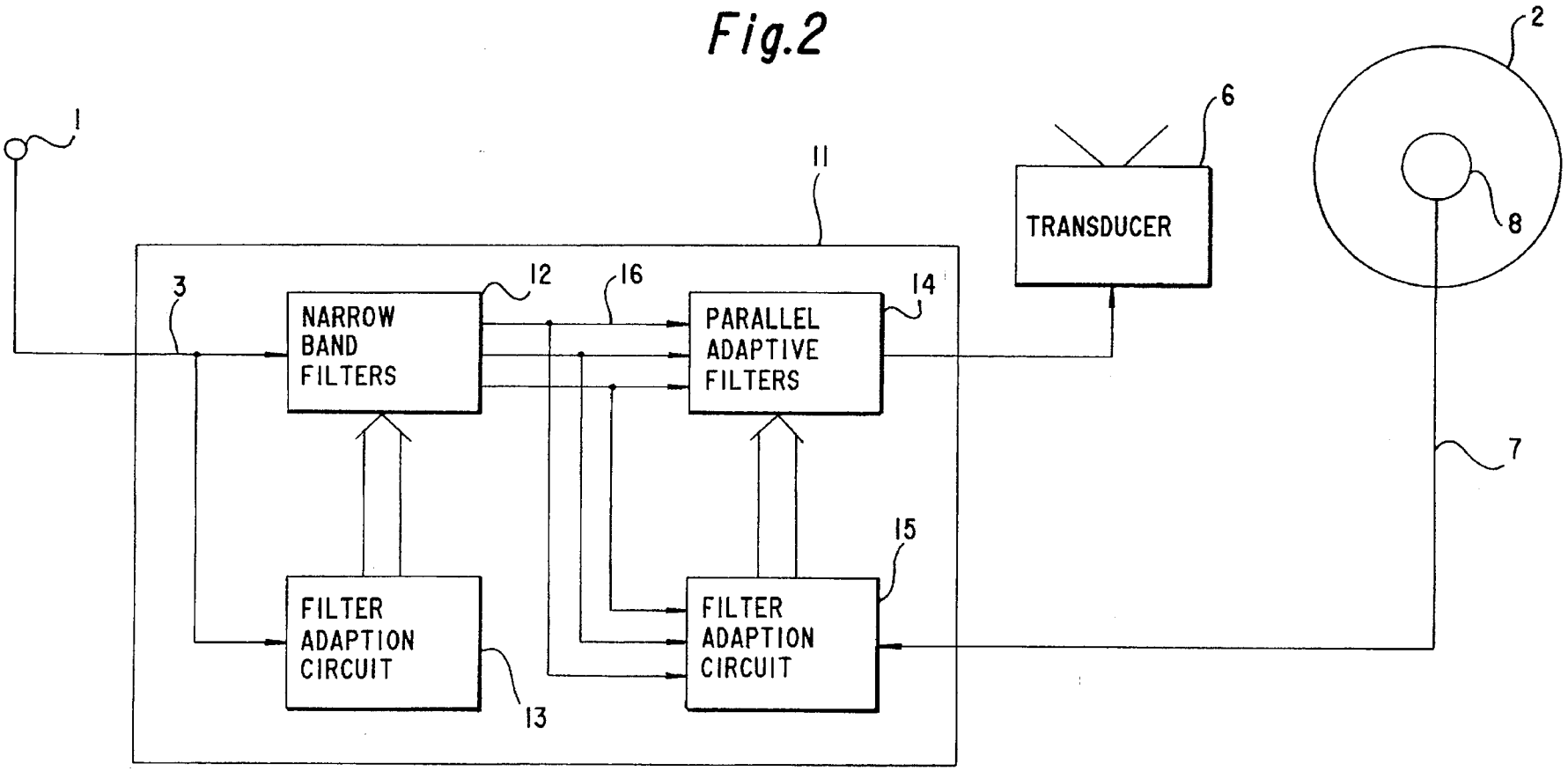
FIG. 2 is a block schematic diagram of an alternative embodiment of the invention

FIG. 2 shows a similar layout to FIG. 1 but with a different internal layout for the circuit means 11. The signal, 3, from the sensor, 1, is fed to one or more narrow-band filters in a first circuit means, 12, whose outputs, 16, are fed one to each of the parallel adaptive filter sections of the adaptive filter, 14. The output of all of the parallel sections are combined to form the drive to the transducer, 6. The adaption of the individual parallel adaptive filter sections of the adaptive filter, 14, is accomplished by the second circuit means, 15, in response to the monitor signal 7 and each of the narrow-band filter outputs 16. The second circuit means uses the adaptive algorithm described above where the coefficients of each of the parallel adaptive filter sections are adapted in accordance with the corresponding input and the monitor signal.

The narrow-band filters in a first circuit means, 12, are either fixed or tunable. In the case when they are fixed there are a sufficient number of them, closely spaced in frequency, so that a tonal signal of any frequency in the range of interest will pass through one of them. The novel feature of this embodiment which allows the selection process to occur is now described.

When a tonal noise is fed to this first circuit means with a bandwidth smaller than the bandwidth of the narrow-band filters there will be an output from one of the filters which is a delayed (and thus phase. shifted) version of the input. Because the cross-correlation of the sensor and monitor signals will have a long correlation time, despite the delay introduced by the filter, this output will have a correlation (for positive time lags) with the monitor signal and thus the corresponding parallel adaptive filter section of the adaptive filter, 14, will be adapted to produce an output signal to attenuate the tonal noise.

When a broadband signal is fed to this first circuit means which has a bandwidth much larger than the bandwidth of the narrow-band filter some output will be generated at each of the filters in the bandwidth of the original signal, but the outputs will be delayed versions of the input (delayed by a time corresponding to the reciprocal of the bandwidth of the narrow-band filters) and because of the short correlation time of the original broadband signal this (effectively) delayed signal will have little cross-correlation with the monitor signal and thus the parallel adaptive filter sections will produce little output and the noise will be unattenuated.

The narrow-band filters may be tunable in order to minimise the complexity of the system by reducing the number of narrow-band filters. When there are only a few tones to be attenuated it may be beneficial to have only a few narrow-band filters, one for each tone. This could be achieved if the spectrum of the signal at input to the first circuit means were monitored to identify the number and frequency of the tones in the signal and the narrow-band filters adjusted to correspond to these frequencies. The narrow-band filters would be continually adjusted by the first adaption unit 13 in order to maintain their centre frequency close to the frequency of the corresponding tone. Their bandwidth would be adjusted to ensure that it was greater than the tone being attenuated and yet not too broad to let broadband signals through with insufficient delay. This processing being done automatically.

Figure 3:
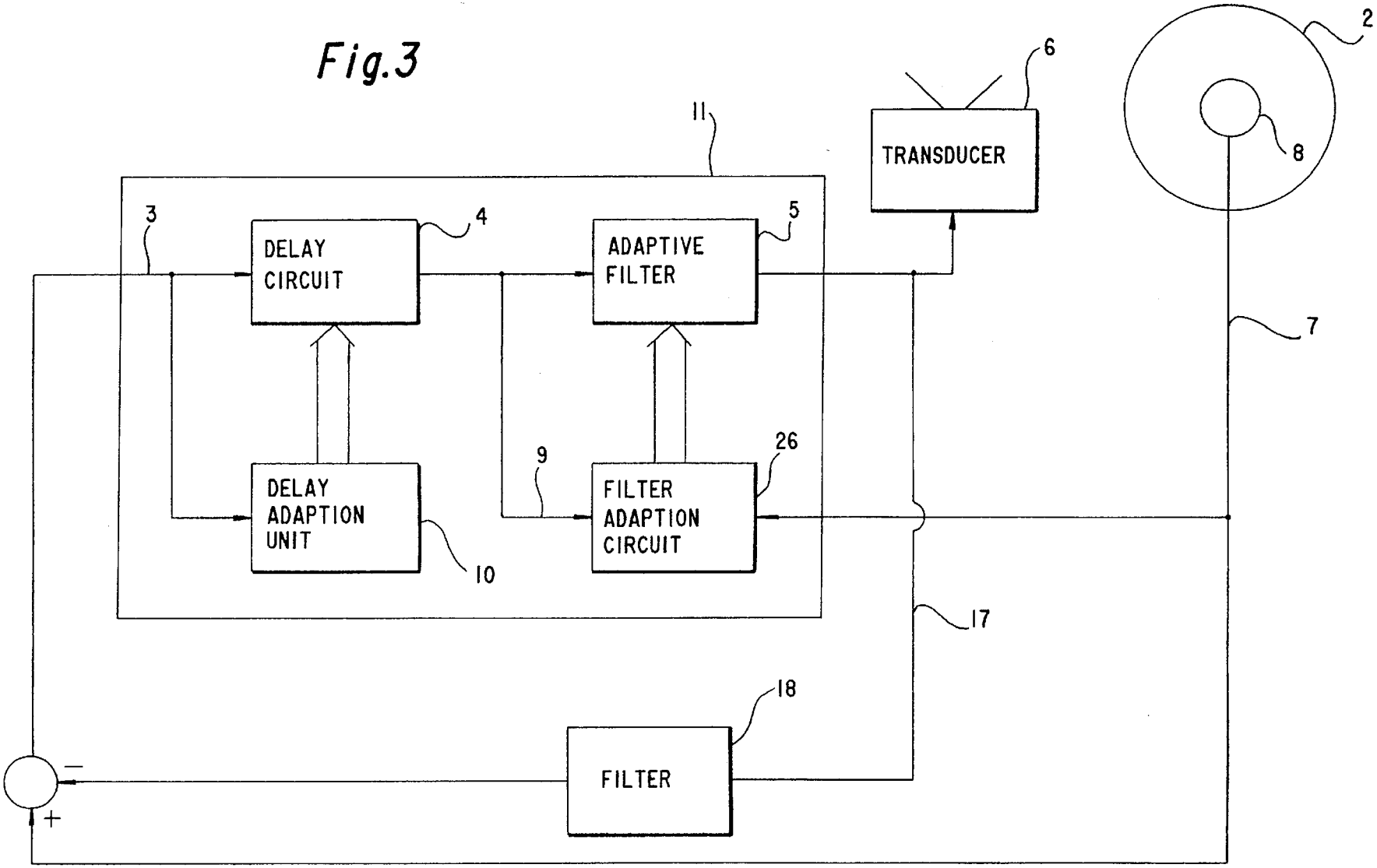
FIG. 3 is a block schematic diagram of one embodiment of the invention where the sensor signal is derived from a sensor in the region to be controlled.

FIG. 3 shows how the sensor Signal may be derived from the sensor, 8, in the region to be controlled, 2. The output, 17, from the circuit means, 11, which in this figure is identical to that shown in FIG. 1, is fed to a filter 18. The characteristic of this filter is adjusted to correspond to the transfer function between signal 17 and signal 7. This is identical to the filter c(i) used in the first adaption unit 26. The output of filter 18 is subtracted from the monitor signal 7 to provide an equivalent signal 3. The characteristic of the filter 18 may be updated in order to maintain it as an accurate representation of the transfer function.

Figure 4:
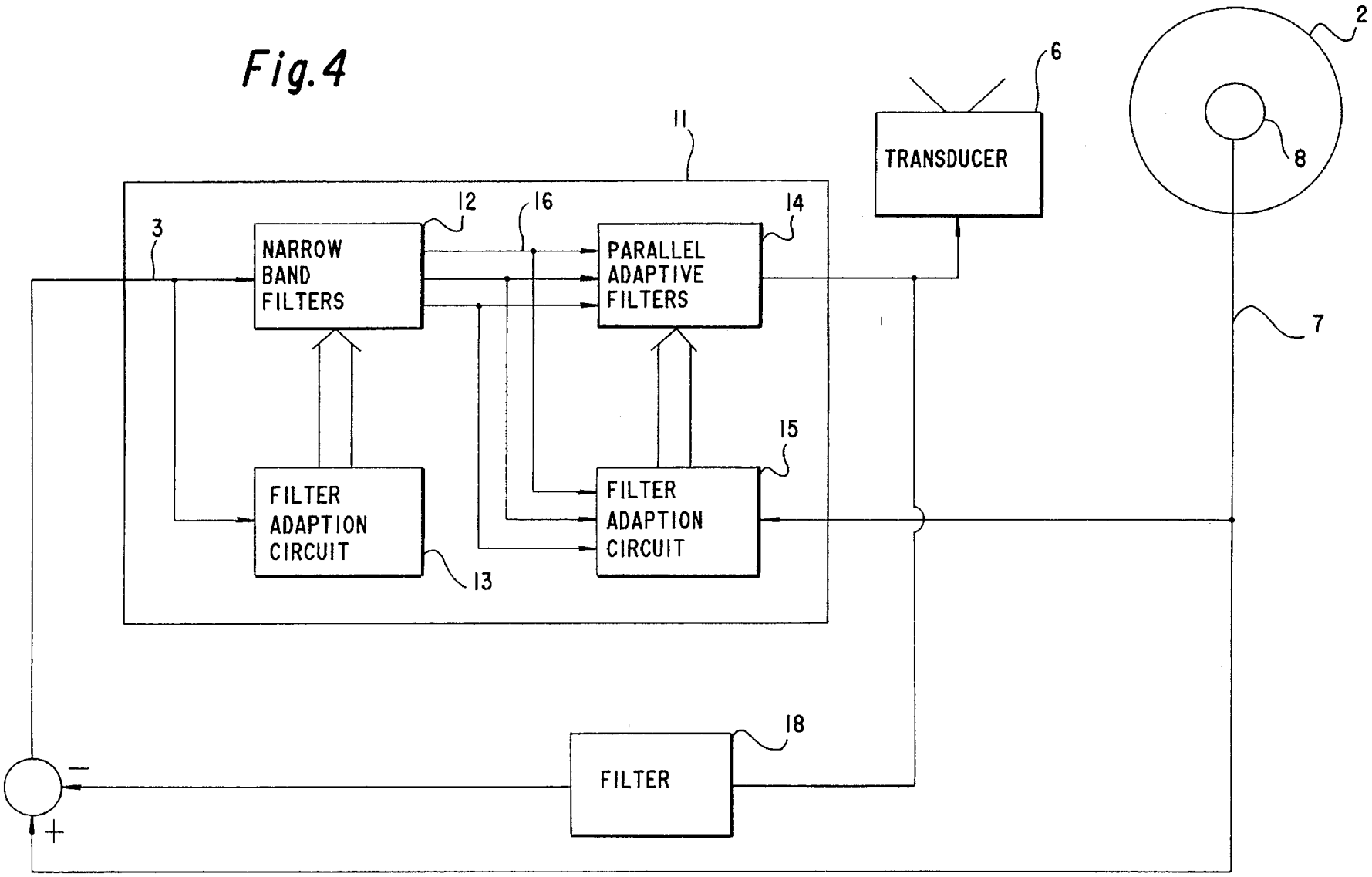
FIG. 4 is a block schematic diagram of an alternative embodiment of the invention where the sensor signal is derived from a sensor in the region to be controlled.

FIG. 4 shows the equivalent circuit where the input to the first circuit means and monitor signals are derived from the same sensor for the circuit means 11 which uses narrow-band filters.

Figure 6:
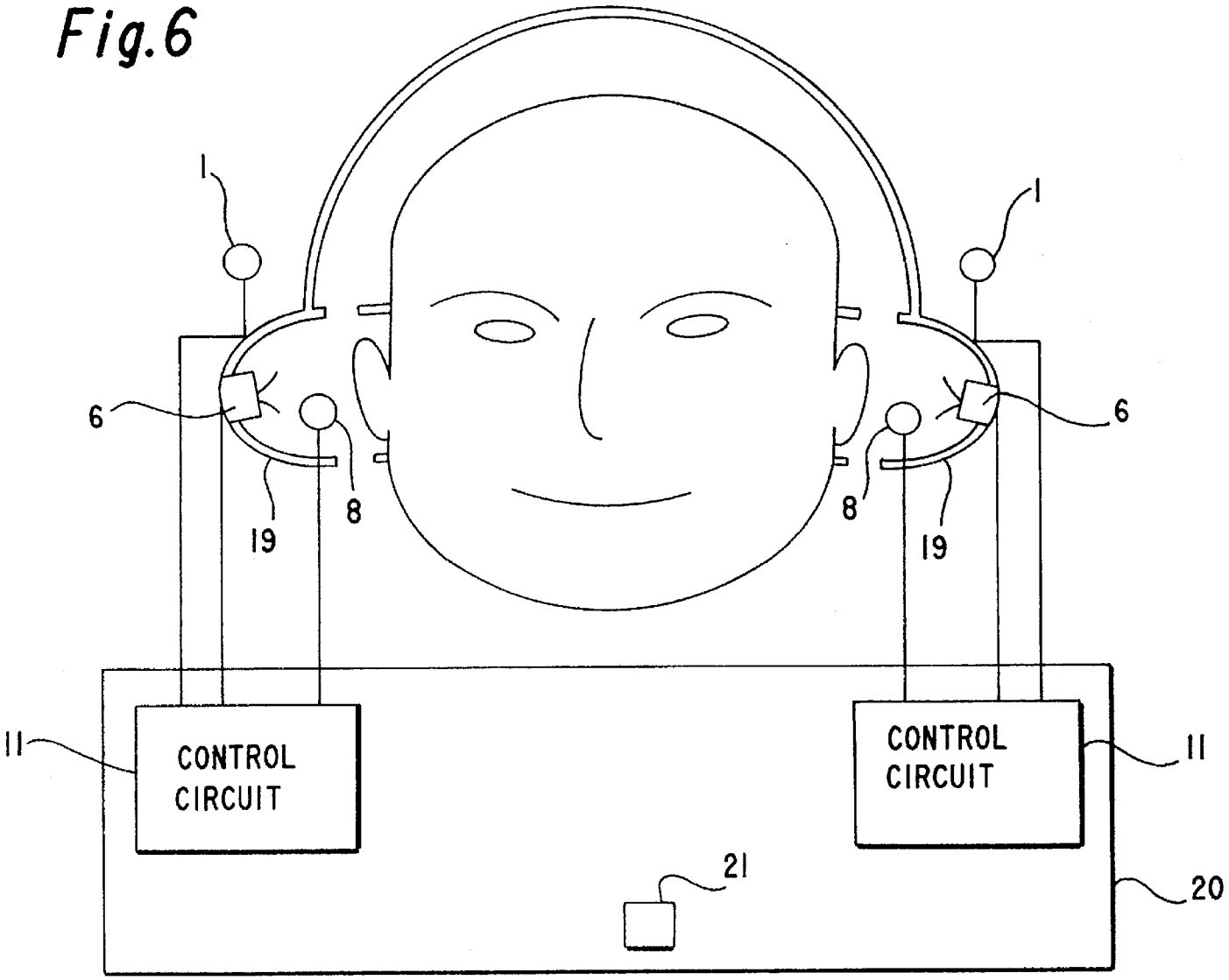
FIG. 6 shows one embodiment of the invention incorporated into a headset.

FIG. 6 shows the system incorporated in a ear defender. There are two systems, one for each ear, contained in a portable box, 20, which includes the battery, 21, for power. The ear defender may be of the open-backed type to allow the desired sounds to reach the ear unimpeded. The sensor, 1, generating the input to the first circuit means is a microphone mounted on the shell of the earpiece, 19 and the sensor, 8, generating monitor signals is a microphone contained in the earpiece close to the ear. The transducer, 6, is a loudspeaker incorporated in the shell of the earpiece.

Figure 7:
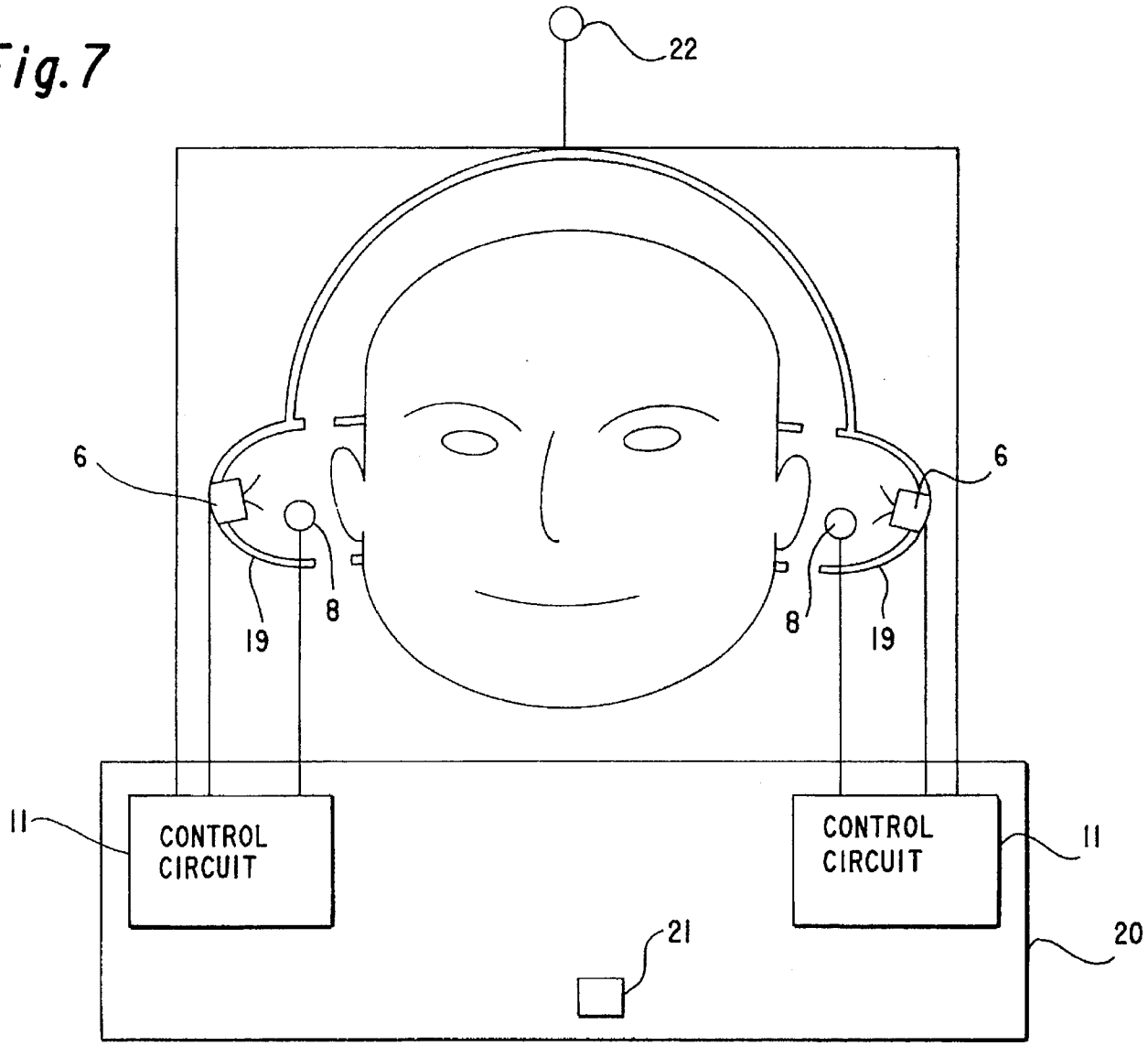
FIG. 7 shows another embodiment of the invention incorporated into a headset.

FIG. 7 shows a system where one microphone 22, is used to provide the input to the first circuit means for both circuits 11.

Figure 8:
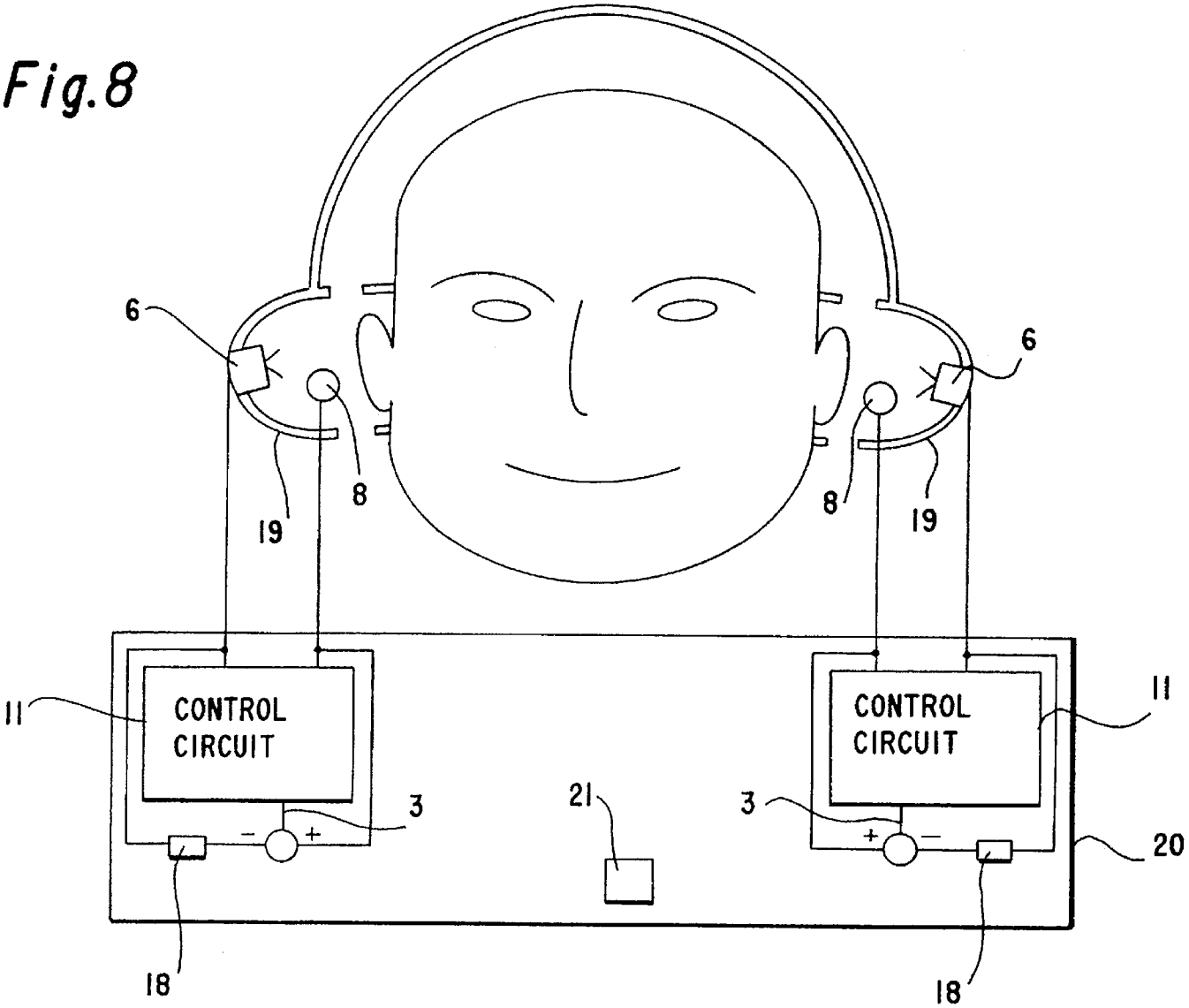
FIG. 8 shows a further embodiment of the invention incorporated into a headset.

FIG. 8 shows the embodiment in which there is no separate sensor to provide an input to the first circuit means (and the input is derived from the monitor signals as described hereinbefore).

An additional input can be fed to one or each of the loudspeakers carrying desirable communication signals for the wearer and these signals will be converted into sounds for the wearer to hear. These sounds will be unaffected by the circuit means, 11. When the headset forms part of a communications headset a microphone would be attached to the headset to receive the wearer's speech. In this circumstance it may be desirable to incorporate an effectively delayed and adaptive filter section into the voice communication channel in order to eliminate the background tonal noises picked up by the speech microphone.

It is to be understood that the effective delay can be achieved by introducing a delay into the signal either before, during or after adaptive filtering or any combination thereof. Thus in FIGS. 1 to 3 some or all of the delay introduced by device 4 can be incorporated in the filter 5 or achieved by a discrete device located between the filter 5 and the transducer 6. The second circuit 76 must of course be adjusted accordingly.

Cross correlation of two signals is referred to in the foregoing specification and the following claims and this expression is defined as follows: the cross correlation (c) of two digitally sampled signals r(i) and w(i) (where the offset between the two signals to be cross correlated is n), is given by:

$$c(n) = 1/N \sum_{i=0.}^{N} r(i) \cdot w(i-n)$$

were N can be any number, and as indicated above n is the number of sampling points by which one signal is offset from the other.

We claim:

1. An active feedforward control system for attenuating tonal content more than random content of noise affecting a quiet region, said system comprising:

transducer means to generate sounds in said quiet region which interfere with the tonal noise to produce at least partial cancellation of tonal noise and thereby attenuate the tonal noise more than random noise in said region, at least one first sensor in said quiet region which provides a first signal related to the residual/attenuated noise in said region, and at least one second sensor in another region separate from said quiet region which provides a second signal which is related at least in part to both the random and tonal content of the noise which would affect the region but for the selective attenuation of the residual noise, signal processing means for processing the first and second signals and/or signals derived therefrom, an adaptive filter means which is supplied with a signal derived from at least the second signal and which has an adaptive characteristic controlled by said processing means and which is adapted to produce signals for driving the transducer means, and delay means for introducing an additional effective delay in the signal path between the second sensor and the transducer, characterized in that the combination of said additional effective delay and the delay from the input to said transducer to the output of said first sensor is greater than the correlation time of the random content of said noise;

and means responsive to said second signal for variably controlling said effective delay introduced by said delay means.

2. An active control system as claimed in claim 1, characterized in that the delay is applied to the signal which is to be supplied to the adaptive filter.

3. An active control system as claimed in claim 1, characterized in that the delay is incorporated in the adaptive filter.

4. An active control system as claimed in claim 1, characterized in that the delay is applied to the signal to be applied to drive the transducer means.

5. An active control system as claimed in claim 1, characterized in that the processing means serves to produce a cross-correlation of the first signal or a signal derived from it, and the signal applied to the adaptive filter.

6. An active control system as claimed in claim 1, characterized in that the effective delay plus the acoustic delay from the transducer to the first sensor is greater than the correlation time of the random content of the noise which is not attenuated.

7. An active control system as claimed in claim 1, characterized in that the said second sensor is located in the said quiet region.

8. An active control system as claimed in claim 1, characterized in that the effective delay plus the acoustic delay from the transducer to the first sensor is greater than the correlation time of the noise which is not attenuated.

9. An active control system as claimed in claim 1, characterized in that the effective delay is realized by the use of narrow band filters in series with the adaptive filter, said narrow band filters being adapted to reject signals at frequencies other than the tonal frequencies to be attenuated.

10. An active control system as claimed in claim 9, and including a set of parallel narrow band filters.

11. An active control system as claimed in claim 1, characterized in that the adaptive filter is arranged to minimize the cross-correlation between the signal supplied to the filter and the signal from the first sensor.

12. An active control system as claimed in claim 11, characterized in that the second sensor is placed in a region which is unaffected by sound from the transducer.

13. An active control system as claimed in claim 1, characterized in that said system is fitted to and forms part of a headset, headphone or ear defender.

14. The system as claimed in claim 13, characterized in that a separate control system is applied to each of the ear covering units.

15. The system as claimed in claim 13, characterized in that the sensors are microphones positioned on the headband of the headset or the outside of the transducer housing.

16. The system as claimed in claim 13, characterized in that the transducers are mounted so as to be close to the ears of the wearer when in use.

17. The system as claimed in claim 13 characterized in that each transducer is mounted in a closed cavity formed by a shell enclosing the ear.

18. The system as claimed in claim 17, characterized in that the material properties of the shell are chosen so as to enhance the transmission of sound in some frequency range.

19. An active control system as claimed in claim 5, characterized in that the cross-correlation is calculated over a single sample or over a number of samples directly or recursively.

20. An active control system as claimed in claim 1, characterized in that the signal supplied to the adaptive filter is made insensitive to the transducer by using a combination of the second signal and the signal supplied to the transducer.

21. An active control system as claimed in claim 1, characterized in that the signal supplied to the adaptive filter is made insensitive to the transducer by using a combination of the second signal and the first signal.

* * * * *